United States Patent [19]

De Luca

[11] Patent Number: 4,752,232

[45] Date of Patent: Jun. 21, 1988

[54] LOCKING DEVICE FOR TELEPHONE SUBSCRIBER PLUGS

[75] Inventor: Paul V. De Luca, Plandome Manor, N.Y.

[73] Assignee: Porta Systems Corp., Syosset, N.Y.

[21] Appl. No.: 22,985

[22] Filed: Mar. 6, 1986

[51] Int. Cl.[4] ..... H01R 13/44

[52] U.S. Cl. ..... 439/133; 439/135

[58] Field of Search ..... 439/133, 136, 135

[56] References Cited

U.S. PATENT DOCUMENTS

| | | | |
|---|---|---|---|
| 4,311,883 | 1/1982 | Kidney | 439/133 |
| 4,624,516 | 11/1986 | White | 439/140 |
| 4,640,564 | 2/1987 | Hill | 439/137 |
| 4,666,225 | 5/1987 | Hampton et al. | 439/140 |

*Primary Examiner*—Gil Weidenfeld
*Assistant Examiner*—Paula A. Austin
*Attorney, Agent, or Firm*—Charles E. Temko

[57] ABSTRACT

A locking device for preventing unauthorized access to a telephone subscriber circuit jack located at a building entrance terminal structure or similar face is disclosed. The jack accommodates a plug having a manually engageable release member and defines a recess accommodating the jack. The locking device includes a housing element defining a generally rectangularly enclosed recess. Means within the recess locates the plug in predetermined position. A forward wall in the housing defines an opening opposite the plug which will provide access. A cover element is supported for selective movement relative to the housing element between first and second positions, the cover element being clear of the opening in the jack in a first position and at least partially overlying the opening in a second position. Latching means is provided on the cover element and locking means on the housing element engages the latching means for preventing movement of the cover from the first position to the second position.

7 Claims, 3 Drawing Sheets

LOCKING DEVICE FOR TELEPHONE SUBSCRIBER PLUGS

BACKGROUND OF THE INVENTION

This invention relates generally to the field of telephony, and more particularly to improved multi-subscriber interface hardware for the purpose of providing security and prevention of environmental contamination.

In a typical installation in a multi-tenant building, a building entrance terminal with 25 or 100 subscriber pairs interconnected thereto is usually mounted upon a building wall, commonly at a basement level. Although a part of the terminal housing is available only to telephone company personnel, of necessity, a second part containing the commonly used R. J. 11 plug is available to the subscribers who connect their equipment, and may remove it for testing.

Such a location lends itself to theft of telephone services, either by unscrupulous tenants who connect their equipment to the lines of other subscribers, or by those who make such interconnection without any legal association with the building. All that is required is the disconnection of a given subscriber equipment plug, and the connection of a telephone hand set using a similar plug in the existing jack. It is also desirable for telephone users to be able to preclude unauthorized persons from having free access to their individual telephone line. Structure for accomplishing this end is most conveniently provided at the location of a standard telephone wall plate outlet or other similar industry standard telephone connection device which contains an R. J. 11 or similar hardware. It is also desirable that such structure may include such circuitry as a maintenance termination unit or noise suppression and radio filtering circuitry most coventiently accommodated behind the R. J. 11 type jack.

SUMMARY OF THE INVENTION

Briefly stated, the invention contemplates the provision of a device which mounts over an R. J. 11 plug consisting essentially of a spring loaded door or cover secured by a manually operated combination lock. The cover may be opened only with knowledge of the correct combination. This structure permits the user to disable his subscriber pair by simply disconnecting the line and allowing the cover to move to closed position. The same lock structure also serves to maintain the plug attached to the end of his subscriber line in installed condition. The device is capable of single as well as multiple mounts.

In a second embodiment, a small terminal block and cover therefor is provided which supports and is supported by the R. J. 11 plug and enables the subscriber to terminate one or more four conductor circuits where this type of subscriber cable has been provided.

BRIEF DESCRIPTION OF THE DRAWING

In the drawing, to which reference will be made in the specification, similar reference characters have been employed to designate corresponding parts throughout the several views.

DETAILED DESCIRPTION OF THE DISCLOSED EMBODIMENT

Figure 1:
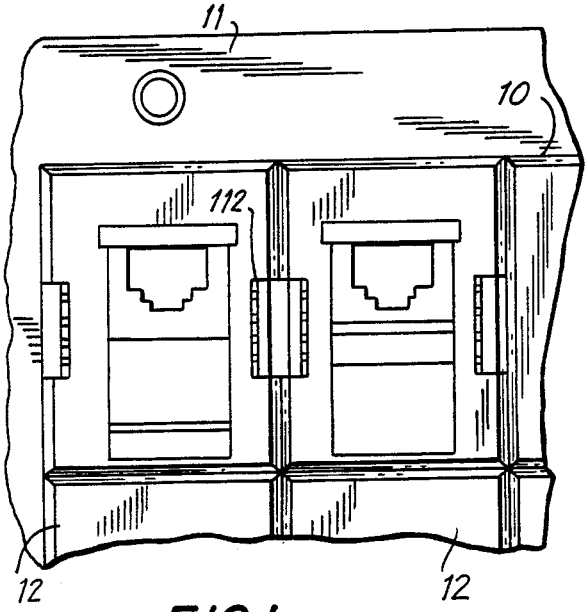
FIG. 1 is a front elevational view of a telephone multicircuit interface forming a part of a disclosed embodiment.
Figure 2:
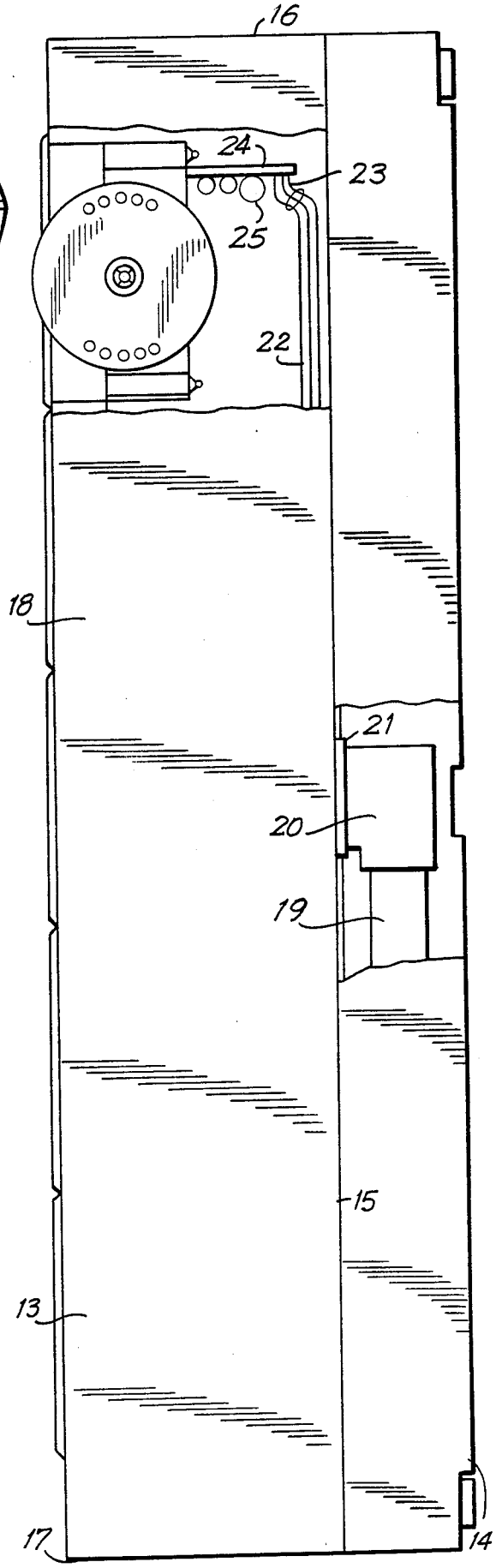
FIG. 2 is a side elevational view thereof.

In accordance with the invention, FIGS. 1 and 2 in the drawing illustrate a building entrance terminal element 10 suitable for use in buildings having up to twenty-five subscriber lines, as for example, a small office building, or condominium. In FIG. 1, a front plate 11 is provided with plural rectangular orifices 12, the plate being secured to a sheet metal body 13 (FIG. 2) having a rear wall 14, and intermediate wall 15, a top wall 16, a bottom wall 17, and a pair of side walls, one of which is indicated by reference character 18. A twenty-five pair cable 19, having a connectorized terminal 20 interconnects with a corresponding jack 21 from which individual subscriber pairs 22 extend, the free end 23 of each such pair being interconnected to a printed circuit board 24 of known type which preferably includes a maintenance termination unit 25, again, of known type. The complete printed circuit assembly, generally indicated by reference character 26, also includes a conventional R. J. 11 jack 27 supported on an undersurface thereof, as best seen in FIG. 3.

Figure 3:
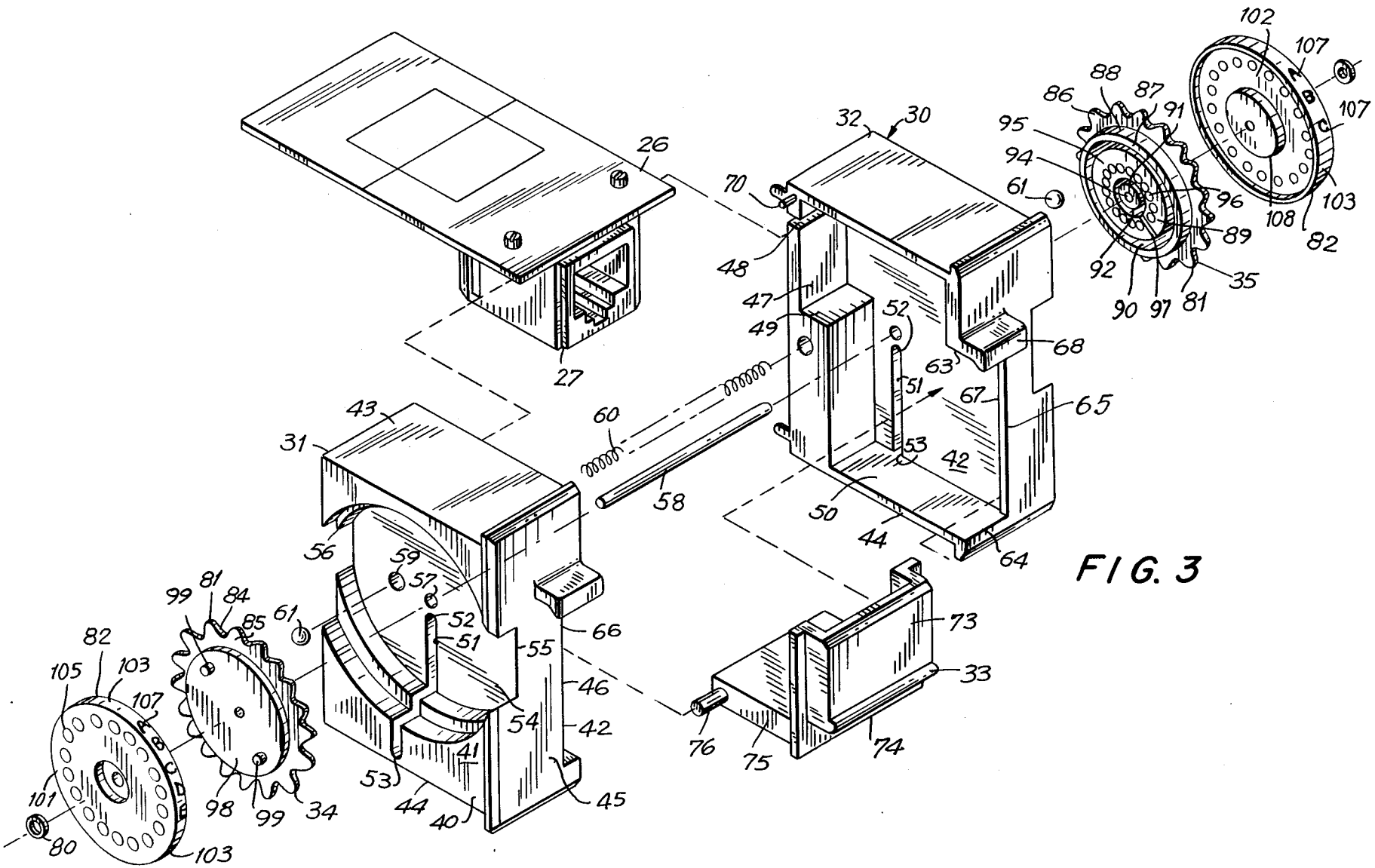
FIG. 3 is an exploded assembly view in perspective of a combination lock and cover construction forming a part of the disclosed embodiment.

With continuing reference to FIG. 3, the device, generally indicated by reference character 30 comprises broadly: first and second main housing elements 31 and 32, a sliding cover element 33, and first and second combination lock elements 34 and 35, respectively.

The housing elements 31 and 32 are generally similar, and symmetrical, each being of suitable molded synthetic material, such as a polycarbonate. Accordingly, a description of one of such elements will serve to describe the other. The element 31 includes a main vertical wall 40 bounded by an outer surface 41 and an inner surface 42. The wall 40 is integrally molded with a planar upper wall 43, a planar lower wall 44, and a forward wall 45 defining a vertical opening 46 facing a rearward wall 47. The wall 47 includes a slotted opening 48 which engages the printed circuit assembly 26 and a horizontal shoulder 49 which supports the jack 27.

When the housing elements 31 and 32 are assembled, there is formed a generallly rectangular recess 50. Extending through the vertical walls 40 are vertical slots 51 having upper and lower terminals 52 and 53, respectively. Extending inwardly from the outer surface 41 are stepped circular recesses 54, having a forward opening 55 and a rearward opening 56 as well as a centrally disposed bore 57 supporting a transversely-extending shaft 58. Parallel to the bore 57 is an offset bore 59 supporting a transversely extending spring 60 comunicating with a ball detent 61 at each end thereof.

The opening 46 is rectangular in configuration, being bounded by an upper edge 63, a lower edge 64, and side edges 65 and 66. Each edge 65–66 is provided with an elongated channel, one of which is indicated by reference character 67. The upper edge 63 is provided with a forwardly facing lip 68 which is adapted to surround an upper edge of the cover element 33. Each of the elements 31–32 is provided with corresponding pins 70 and corresponding sockets (not shown) to facilitate assembly.

The cover element 33 is also preferably formed as a molding from synthetic resinous materials and includes a vertical wall 73 having a finger-engaging projection 74 supported upon a horizontal wall 75 having laterally extending pintles 76 which slidably engage the slots 51 for vertical movement.

The combination lock elements 34 and 35 are also similar and symmetrical, and are supported on the shaft 58 with the aid of resilient fasteners 80. Each element includes a manually engageable wheel 81 and an index wheel 82. The manually engageable wheel 81 is preferably a synthetic resinous molding and includes a first planar member 84 having first and second surfaces 85 and 86, respectively. As best seen from the upper right-hand portion of FIG. 3, the second surface 86 mounts an outer ring member 87 forming a circular pathway 88, a medial ring member 89 forming a second circular pathway 90, and an inner ring member 91 forming a third curvilinear pathway 92 having a central opening 94 engaging the shaft 58. The medial ring member 89 includes an exposed surface 95 having circular detents 96 and is provided with a communicating radially extending channel 97 which extends sufficiently to permit communication between each of the pathways 88, 90 and 92.

Upon an opposite surface is an integrally molded circular plate 98 having a pair of studs 99. (See lower left-hand portion of FIG. 3).

The index wheel 82 provides a means for setting the combination, which normally will not be adjustable after assembly. It is bounded by first and second parallel surfaces 101 and 102 as well as a peripheral surface 103. The surface 101 is provided with a plurality of arcuately disposed recesses 105 selectively engageable by the studs 99 to thereby determine the relative position of indicia 107 on the surface 103. Through bores 59 cooperate with the ball detents 61 which project through the undulating peripheral edge of the wheel 81 to selectively fix the position thereof.

The operation of the device will be apparent from a consideration of the drawings. After assembly of the individual device 30, it is inserted in one of the rectangular orifices 12 to be maintained by a spring clip 112 (FIG. 1). At the time of installation, the cover element may be completely closed and maintained in position until the proper combination is dialed by moving in the innermost pathway 92.

Upon the assignment of an R. J. 11 jack to an individual subscriber, and the providing to him of the proper combination, this can be conveniently dialed permitting the door to be completely opened for insertion of the R. J. 11 plug (not shown). Following this, the cover element is moved upwardly a distance sufficient to cover the manually releasable handle on the R. J. 11 plug, but allow passage of the subscriber pair through the opening 46. The wheels 81 are then rotated to lock the cover element in this position. Since the releasable latch member on the plug element is not then accessible, it is impossible to remove the plug without knowledge of the proper combination, or the readily visible destruction of the device. Even if an unauthorized party succeeds in disengaging the device from the spring clip 112, the plug is still securely locked within the device 30, necessitating breaking the cover element 33, or otherwise destroying the housing elements. It is to be noted that the cover element can be locked in any of three positions, including a completely open position, should this be desirable for servicing purposes. Locking the cover element in completely closed position provides environmental protection when the subscriber circuit is not in use.

Figure 4:
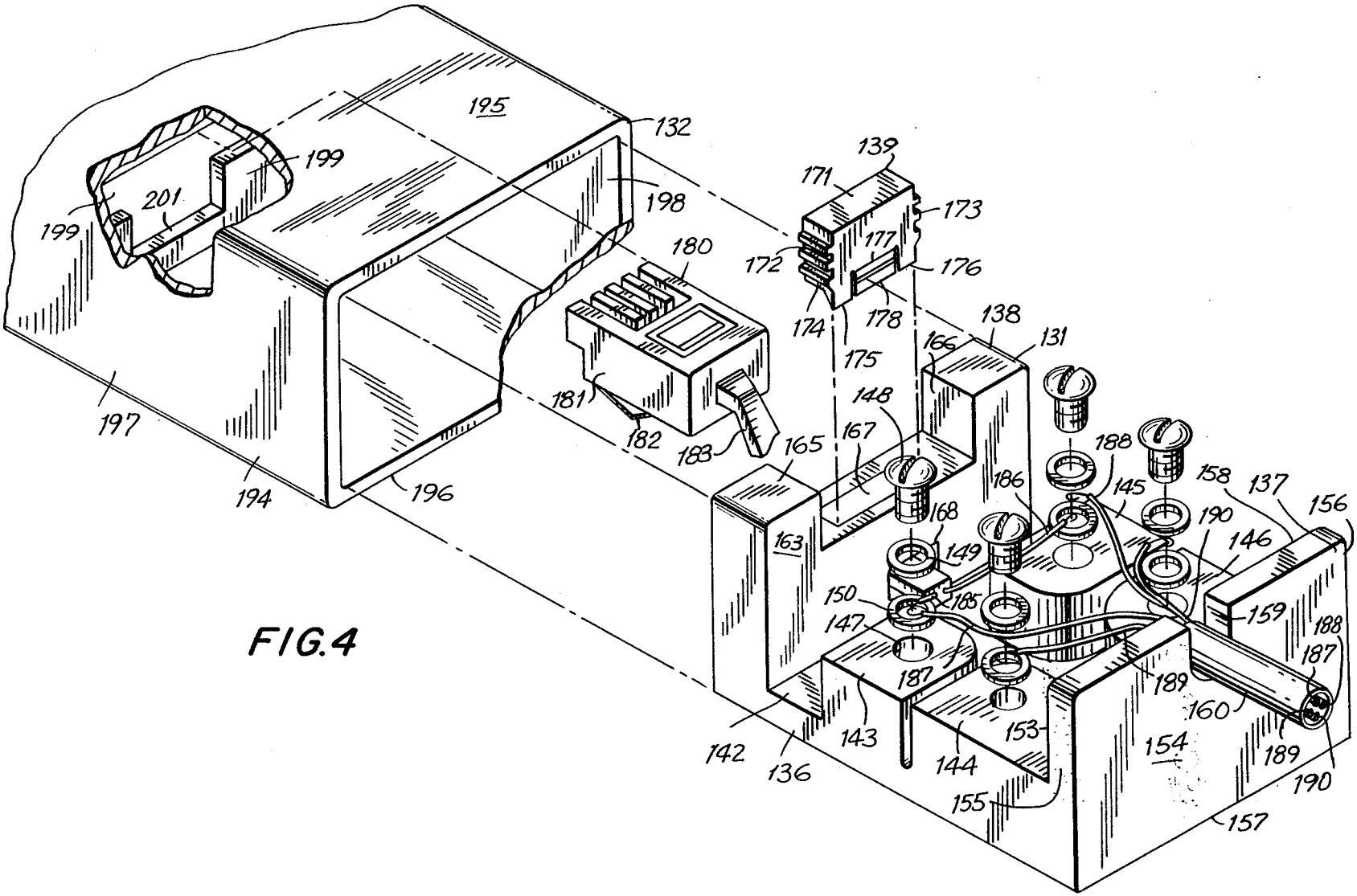
FIG. 4 is a fragmentary exploded view in perspective showing an optional terminal block and cover element for use with the block and cover element shown in FIG. 3.

Turning now to the optional structure illustrated in FIG. 4 of the drawing, there is illustrated a means for enabling an individual subscriber to terminate one or more four conductor leads from his equipment to the point of interface. The structure will normally not be required in the case of a two conductor cable.

The optional structure, which is in the form of a shielded terminal block comprises broadly a terminal block element 131 and a sliding cover element 132 therefor.

The block element 131 is preferably formed from molded synthetic resinous material, and is of rectangular configuration. It includes a bottom wall 136, a first outer end wall 137, a second inner end wall 138, and a cable lock member 139. The bottom wall 136 is bounded by a lower surface (not shown), a parallel upper surface 142, the surface 142 having four screw mounting terminal areas 143, 144, 145, and 146. Each area includes a threaded bore 147 and corresponding terminal screw 148 surrounded by first and second conductive washers 149 and 150.

The outer end wall 137 is bounded by an inner surface 153, an outer surface 154, side edge surfaces 155 and 156, a lower edge 157 and an upper edge surface 158 having a U-shaped notch 159 for the accommodation of a four conductor cable 160.

The inner end wall 138 includes an inner surface 163, an outer surface (not shown), an upper surface 165 from which extends a rectangular notch 166. The notch 166 communicates with a rectangular vertically extending channel 167 in turn communicating with a rectangular horizontally oriented channel 168.

The cable lock member 139 is formed as a synthetic resinous molding, and is bounded by an upper surface 171, first and second grooved side surfaces 172 and 173, and a lower surface 174 from which depend a pair of downwardly extending projections 175 and 176 which form a notch 177 having a flexible cushioning tab 178 therein.

Reference character 180 designates a conventional R. J. 11 plug including a generally rectangular body 181 and a manually operable locking tongue 182. The plug 180 is normally supplied with an outwardly extending cable enclosed in a jacket 183 which encloses first and second conductors 185 and 186. The subscriber cable 160, in this case will include first and second conductors 187 and 188 and third and fourth conductors 189 and 190.

The slidably engageable cover element 132 is, again, a synthetic resinous molding and includes a box-like body 194 including an upper wall 195, a lower wall 196, side walls 197 and 198 and an inner end wall 199 having a rectangular opening 201 selectively engaging a corresponding projection (not shown) on the block element to form a snap-on detent, the effect of which is readily overcome by applying a force through the plug opening in the end wall against the end wall of the block element.

From a consideration of FIG. 4, it may be noted that the structure is assembled by first interconnecting the subscriber cable to the block element. Next, the plug and accommpanying cable jacket is positioned outwardly of the inner wall, and after properly determining the length of the cable jacket, it is inserted into the channel 168, following which the lock member 139 is inserted into the channel 167 and pressed against the cable jacket to secure the same against movement. The plug 180 is then guided through the opening in the end wall of the cover element 132, and the cover slid into position to completely enclose the block element. In this condition, the plug 180 may be inserted through the opening 48 and engaged with the jack prior to the moving of the cover element 32 to partially closed position. Owing to the shortness of the cable jacket interconnecting the plug with the block element, this movement effectively prevents movement of the block element, or access to the terminals thereon without physically breaking the cable jacket or otherwise damaging the block element.

I wish it to be understood that I do not consider the invention limited to the precise details of structure shown and set forth in this specification, for obvious modifications will occur to those skilled in the art to which the invention pertains.

I claim:

1. A locking device for preventing unauthorized access to a telephone subscriber circuit jack located at a building entrance terminal structure or similar interface, said jack accommodating a plug having a manually engageable release member, said structure defining a recess accommodating said jack, said locking device comprising: a generally rectangular housing element having first and second side walls, an upper wall, a lower wall, a rear wall and a forward wall defining a generally rectangular enclosed recess; means within said recess for locating said plug in predetermined position, said forward wall defining an opening therein opposite said plug to provide access thereto; a cover element supported for selective movement relative to said housing element between first and second positions, said cover element being clear of said opening in said jack in a first position, and at least partially overlying said opening in said second position; latching means on said cover element slidably movable therewith, and locking means on said housing element engaging said latching means for preventing movement of said cover from said first position to said second position.

2. A locking device in accordance with claim 1, further characterized in said locking means including a rotating combination-type lock.

3. A locking device in accordance with claim 2, further characterized in said combination-type lock including a pair of coaxially aligned rotating members, each of said members defining a radially oriented recess, said latching means including a corresponding pair of laterally projecting pins, each of said pins being slidably engageable with a recess in a rotating member when said rotating members are in predetermined relative rotational position.

4. A locking device in accordance with claim 3, further comprising resilient detent means for maintaining said rotating members in any of a plurality of rotational positions.

5. A locking device in accordance with claim 3, in which said cover element may be positioned to completely overlie said opening in said forward wall in the absence of a corresponding plug.

6. A locking device in accordance with claim 3, further characterized in said rotating means defining a plurality of circular pathways communicating with said radially oriented recess in each of said rotating members, said pins being disposed in one of said pathways in a respective rotating member to fix said cover element in one of said first and second positions.

7. A device in accordance with claim 6, further characterized in said pathways being three in number, and said cover element is selectively positionable in any of three relative positions, one of which causes said cover element to partially overlie said opening.

* * * * *